US011098462B2

(12) United States Patent
Ogura et al.

(10) Patent No.: US 11,098,462 B2
(45) Date of Patent: Aug. 24, 2021

(54) CONSTRUCTION MACHINE

(71) Applicant: Hitachi Construction Machinery Co., Ltd., Tokyo (JP)

(72) Inventors: Kouhei Ogura, Tsuchiura (JP); Katsuaki Kodaka, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 283 days.

(21) Appl. No.: 16/329,517

(22) PCT Filed: Mar. 14, 2018

(86) PCT No.: PCT/JP2018/010085
§ 371 (c)(1),
(2) Date: Feb. 28, 2019

(87) PCT Pub. No.: WO2018/180512
PCT Pub. Date: Oct. 4, 2018

(65) Prior Publication Data

US 2019/0194908 A1 Jun. 27, 2019

(30) Foreign Application Priority Data

Mar. 31, 2017 (JP) ..... JP2017-069600

(51) Int. Cl.
*E02F 9/22* (2006.01)
*E02F 9/26* (2006.01)
(Continued)

(52) U.S. Cl.
CPC ..... *E02F 9/2203* (2013.01); *E02F 9/22* (2013.01); *E02F 9/2228* (2013.01);
(Continued)

(58) Field of Classification Search
CPC . E02F 9/265; E02F 9/2203; E02F 3/50; E02F 9/22; E02F 9/2228; E02F 9/2235; F15B 11/08
See application file for complete search history.

(56) References Cited

U.S. PATENT DOCUMENTS 8,424,299 B2 * 4/2013 Kakizawa ..... E02F 9/2242 60/368
2010/0089045 A1 * 4/2010 Shimada ..... E02F 9/2285 60/327
(Continued)

FOREIGN PATENT DOCUMENTS

JP 5-106606 A 4/1993
JP 2001-39672 A 2/2001
(Continued)

OTHER PUBLICATIONS

International Search Report (PCT/ISA/210) issued in PCT Application No. PCT/JP2018/010085 dated May 29, 2018 with English translation (six (6) pages).
(Continued)

*Primary Examiner* — Peter D Nolan
*Assistant Examiner* — Demetra R Smith-Stewart
(74) *Attorney, Agent, or Firm* — Crowell & Moring LLP

(57) ABSTRACT

A construction machine is provided. If the rotational speed of a prime mover is set lower than a rated rotational speed and the delivery rate of a hydraulic pump is lowered, the construction machine can prevent deterioration of the operability in slow speed operation works by keeping wide a lever operation range in which the rate of flow supplied to a hydraulic actuator is variable. A center bypass control valve (2) is arranged downstream of a plurality of directional flow control valves (1, 20, 21) in a center bypass line (12), and if an engine rotational speed (N) detected by a rotational speed sensor (19) is lower than a rated rotational speed
(Continued)

(Nmax), a controller (10) calculates a combined opening area obtained by combining opening areas of the plurality of directional flow control valves in the center bypass line based on operation pilot pressures (Pp1, Pp3 to Pp6) detected by pressure sensors (7, 25, 26, 28, 29) and controls the center bypass control valve such that an opening area of the center bypass control valve becomes smaller than the combined opening area.

3 Claims, 10 Drawing Sheets

(51) Int. Cl.
*F15B 11/08* (2006.01)
*F15B 11/02* (2006.01)
*E02F 3/50* (2006.01)

(52) U.S. Cl.
CPC ..... *E02F 9/2235* (2013.01); *E02F 9/265* (2013.01); *F15B 11/02* (2013.01); *F15B 11/08* (2013.01); *E02F 3/50* (2013.01)

(56) References Cited

U.S. PATENT DOCUMENTS

2013/0311052 A1* 11/2013 Edamura ..... E02F 9/123 701/50
2015/0330059 A1* 11/2015 Tanaka ..... E02F 9/226 60/421
2016/0003266 A1* 1/2016 Imura ..... E02F 9/123 60/418
2018/0030692 A1* 2/2018 Kamoshita ..... F15B 11/17
2018/0238027 A1* 8/2018 Kishida ..... E02F 9/2228

FOREIGN PATENT DOCUMENTS

JP 4215409 B2 1/2009
JP 2017-57925 A 3/2017
WO WO 2017/014324 A1 1/2017
WO WO 2017/046401 A1 3/2017

OTHER PUBLICATIONS

Japanese-language Written Opinion (PCT/ISA/237) issued in PCT Application No. PCT/JP2018/010085 dated May 29, 2018 (six (6) pages).
Notification Concerning Documents Transmitted (PCT/IB/310) issued in PCT Application No. PCT/JP2018/010085 dated May 16, 2019, including English translation of document C2 (Japanese-language Written Opinion (PCT/ISA/237) previously filed on Feb. 28, 2019) (10 pages).

* cited by examiner

CONSTRUCTION MACHINE

TECHNICAL FIELD

The present invention relates to a construction machine such as a hydraulic excavator, and in particular relates to a construction machine such as a hydraulic excavator that performs slow speed operation works such as crane works.

BACKGROUND ART

Construction machines such as hydraulic excavators are in some cases used at reduced work machine operation speeds in works that require careful operation such as crane works or ground leveling works (slow speed operation works). Patent Document 1, for example, discloses a hydraulic drive control system of construction machines that is capable of reducing work machine operation speeds.

Patent Document 1 describes a hydraulic drive control system having: a prime mover; a hydraulic pump driven by this prime mover; an actuator driven by hydraulic fluid that occurs from this hydraulic pump; operation means provided to this actuator; a directional control valve that is switchingly operated according to an operation direction and operation amount of an operation lever of this operation means and controls a flow of the hydraulic fluid supplied to the actuator; a pilot pump that produces a pilot primary pressure; and a pilot valve that is provided to the operation means, produces a pilot secondary pressure according to the operation direction and operation amount of the operation lever based on the pilot primary pressure and causes the directional control valve to function. This hydraulic drive control system can reduce work machine working speeds by reducing rotational speeds of prime movers and reducing delivery rates of hydraulic pumps.

PRIOR ART DOCUMENT

Patent Document

Patent Document 1: Japanese Patent No. 4215409

SUMMARY OF THE INVENTION

Problem to be Solved by the Invention

However, with the hydraulic drive control system described in Patent Document 1, if the delivery rate of a hydraulic pump is lowered by setting the engine rotational speed lower than an engine rotational speed used at the time of a normal work (rated rotational speed), the lever operation amount increases when hydraulic fluid starts flowing into a load holding side of a hydraulic actuator, i.e., when the hydraulic actuator starts moving, and a lever operation range in which the rate of flow supplied to the hydraulic actuator is variable shrinks; therefore, operability in slow speed operation works deteriorates.

The present invention is made in view of the above-mentioned problems, and an object thereof is to provide a construction machine. If the rotational speed of a prime mover is set lower than a rated rotational speed and the delivery rate of a hydraulic pump is lowered, the construction machine can prevent deterioration of the operability in slow speed operation works by keeping wide a lever operation range in which the rate of flow supplied to a hydraulic actuator is variable.

Means for Solving the Problem

In order to achieve the above-mentioned object, the present invention provides a construction machine including a hydraulic control system. The hydraulic control system includes: a prime mover; a variable displacement hydraulic pump driven by the prime mover; a plurality of hydraulic actuators driven by discharge fluid of the hydraulic pump; a plurality of center bypass directional flow control valves arranged in a center bypass line having an upstream end connected to the hydraulic pump and a downstream end connected to a hydraulic fluid tank, and controlling flows of hydraulic fluid supplied from the hydraulic pump to the plurality of hydraulic actuators; and a plurality of operation devices provided correspondingly to the plurality of hydraulic actuators and operating the respective directional flow control valves. The construction machine is characterized by including: an operation amount sensor detecting operation amounts of the plurality of directional flow control valves; a rotational speed sensor detecting a rotational speed of the prime mover; a center bypass control valve arranged downstream of the plurality of directional flow control valves in the center bypass line; and a controller that is configured to calculate, if the rotational speed of the prime mover detected by the rotational speed sensor is lower than a rated rotational speed which is an engine rotational speed used at a time of a normal work, a combined opening area obtained by combining opening areas of the plurality of directional flow control valves in the center bypass line based on the operation amounts of the plurality of operation devices detected by the operation amount sensor, and to control the center bypass control valve such that an opening area of the center bypass control valve becomes smaller than the combined opening area.

According to the thus-configured present invention, if the rotational speed of the prime mover is set lower than the rated rotational speed, and the delivery rate of the hydraulic pump is lowered, an increase of the lever operation amount with which the hydraulic fluid starts flowing into a load holding side of the hydraulic actuator, i.e., with which the hydraulic actuator starts moving, can be suppressed. Thereby, since a lever operation range in which the rate of flow supplied to the hydraulic actuator is variable is kept wide, deterioration of operability in slow speed operation works can be prevented.

Effects of the Invention

According to the present invention, if the rotational speed of a prime mover is set lower than a rated rotational speed and the delivery rate of a hydraulic pump is lowered, a lever operation range in which the rate of flow supplied to a hydraulic actuator is variable can be kept wide, and deterioration of the operability in slow speed operation works can be prevented.

MODES FOR CARRYING OUT THE INVENTION

Figure 1:
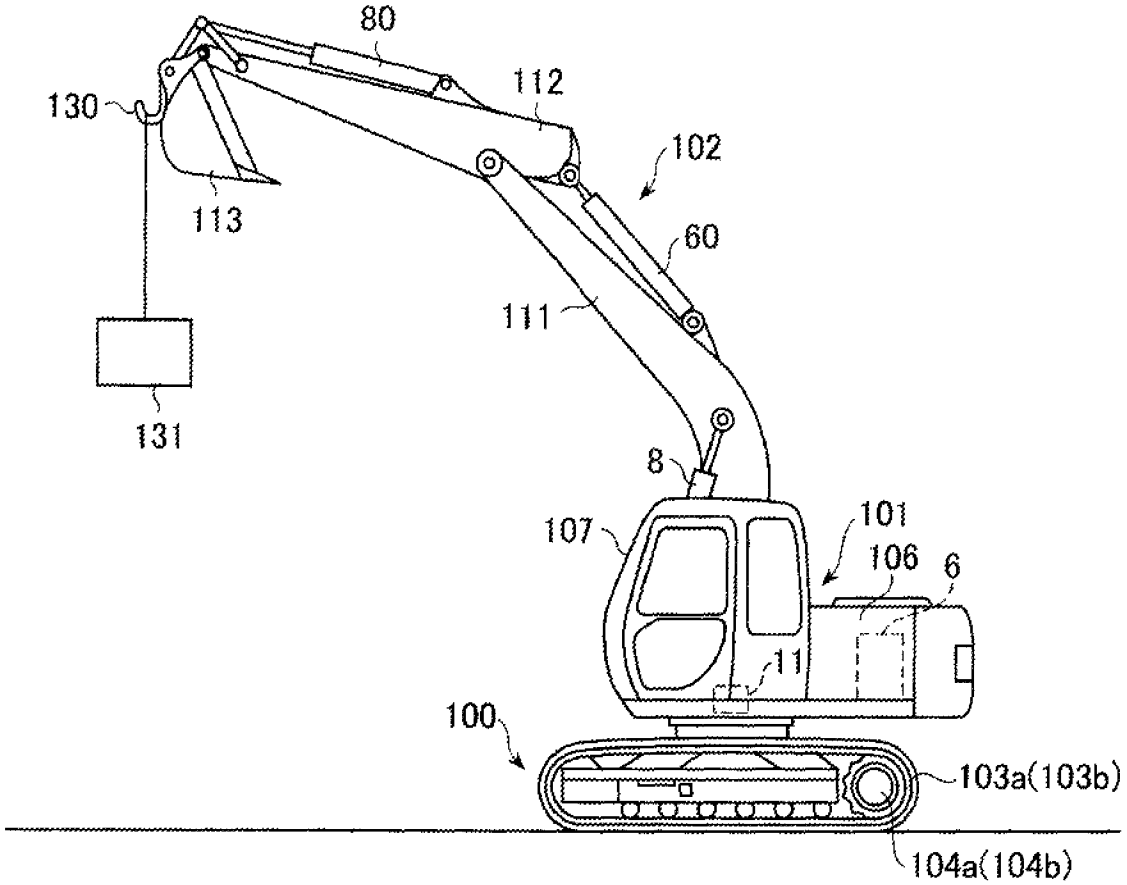
FIG. 1 is a figure illustrating an external appearance of a hydraulic excavator as one example of construction machines according to an embodiment of the present invention.

FIG. 1 is a figure illustrating an external appearance of a hydraulic excavator as one example of construction machines according to the present embodiment.

In FIG. 1, a hydraulic excavator includes a lower track structure 100, an upper swing structure 101, and a front work implement 102. The lower track structure 100 has left and right, crawler-type track devices 103*a* and 103*b*, and is driven by left and right travelling motors 104*a* and 104*b*. The upper swing structure 101 is mounted on the lower track structure 100 such that the upper swing structure 101 can swing, and is swing-driven by a swing motor not illustrated. The front work implement 102 is attached to a front portion of the upper swing structure 101 such that the front work implement 102 can revolve in the upward and downward directions. The upper swing structure 101 is provided with an engine room 106 and a cabin (cab) 107. In the engine room 106, an engine (prime mover) 6 and hydraulic equipment such as a hydraulic pump 4 or a pilot pump 9 are arranged. In the cabin 107, operation devices such as operation lever units 13, 24, and 27 illustrated in FIG. 2 or an operation pedal device not illustrated are arranged.

The front work implement 102 has an articulated structure having a boom 111, an arm 112 and a bucket 113. The boom 111 revolves in the upward and downward directions along with expansion and contraction of a boom cylinder 8. The arm 112 revolves in the upward and downward directions and forward and backward directions along with expansion and contraction of an arm cylinder 60. The bucket 113 revolves in the upward and downward directions and forward and backward directions along with expansion and contraction of a bucket cylinder 80.

Figure 2:
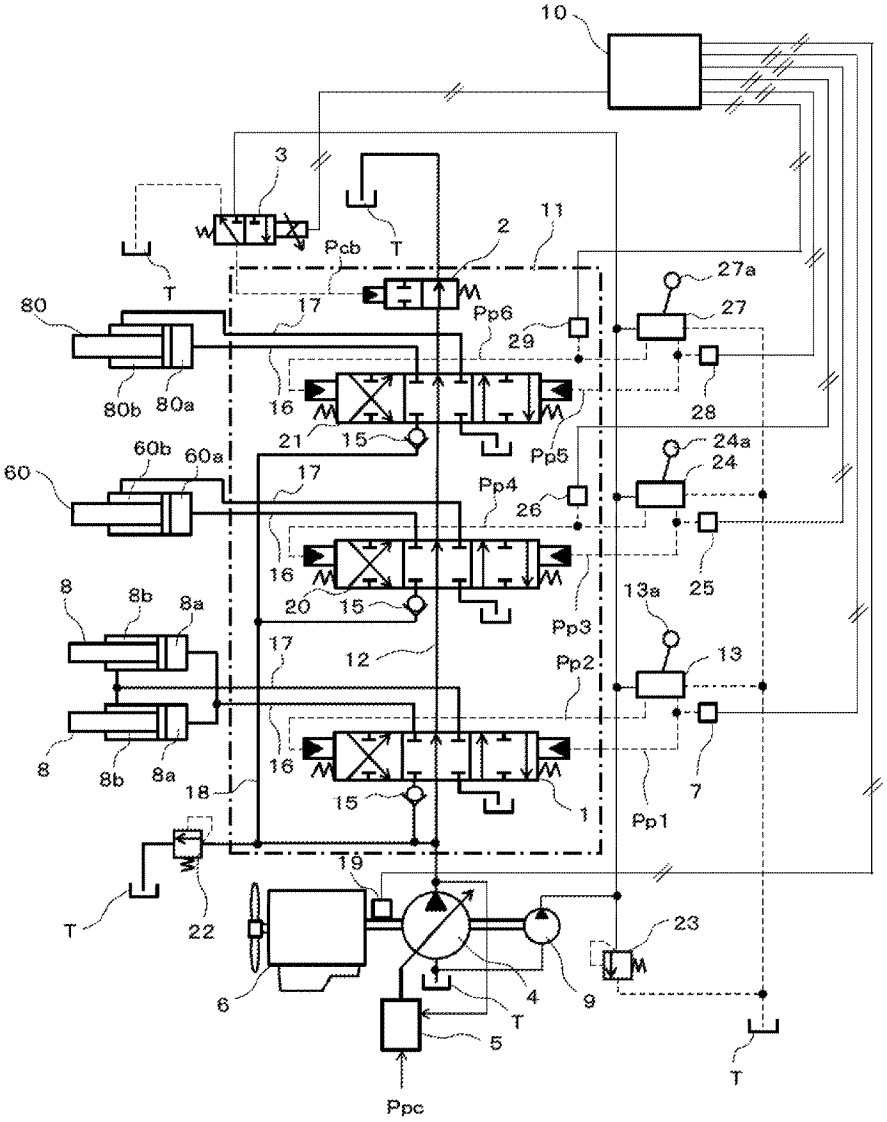
FIG. 2 is an overall configuration diagram of a hydraulic control system mounted on the hydraulic excavator illustrated in FIG. 1.

FIG. 2 is an overall configuration diagram of a hydraulic control system mounted on the hydraulic excavator illustrated in FIG. 1. In FIG. 2, for the sake of simplicity of explanation, portions related to the left and right travelling motors 104*a* and 104*b*, and hydraulic actuators such as the arm cylinder 60 or the bucket cylinder 80 illustrated in FIG. 1 are omitted.

In FIG. 2, the hydraulic control system in the present embodiment includes: the variable displacement hydraulic pump (main pump) 4 and the fixed displacement pilot pump 9 that are driven by the engine 6; the plurality of hydraulic actuators 8, 60, and 80 driven by hydraulic fluid discharged from the hydraulic pump 4; and a control valve device 11 having built-in pilot-type directional flow control valves 1, 20, and 21 that control flowing directions and flow rates of hydraulic fluid supplied from the hydraulic pump 4 to the hydraulic actuators 8, 60, and 80.

A discharged fluid line of the hydraulic pump 4 is connected to a hydraulic fluid tank T via a main relief valve 22. When a discharge pressure of the hydraulic pump 4 reaches a maximum discharge pressure, the main relief valve 22 opens, and discharges hydraulic fluid to the hydraulic fluid tank T. In addition, a discharged fluid line of the pilot pump 9 is connected to the hydraulic fluid tank T via a pilot relief valve 23. When a discharge pressure of the pilot pump 9 reaches a maximum discharge pressure, the pilot relief valve 23 opens, and discharges hydraulic fluid to the hydraulic fluid tank T.

The directional flow control valves 1, 20, and 21 are of center bypass-type, and are arranged on a center bypass line 12 communicating with the discharged fluid line of the hydraulic pump 4. That is, the center bypass line 12 extends penetrating through the directional flow control valves 1, 20, and 21. An upstream end of the center bypass line 12 is connected to the discharged fluid line of the hydraulic pump 4, and a downstream end thereof is connected to the hydraulic fluid tank T.

The hydraulic actuator 8 is a hydraulic cylinder (boom cylinder) that raises and lowers the boom 111, and the directional flow control valve 1 is a first directional flow control valve for boom control. The hydraulic actuator 60 is a hydraulic cylinder (arm cylinder) that pushes and pulls the arm 112, and the directional flow control valve 20 is a second directional flow control valve for arm control. The hydraulic actuator 80 is a hydraulic cylinder (bucket cylinder) that pushes and pulls the bucket 113, and the directional flow control valve 21 is a third directional flow control valve for bucket control.

The boom cylinder 8 is connected to the directional flow control valve 1 via actuator lines 16 and 17. The boom cylinder 8 has a bottom-side cylinder chamber 8*a* and a rod-side cylinder chamber 8*b*. The bottom-side cylinder chamber 8*a* is connected to the actuator line 16, and the rod-side cylinder chamber 8*b* is connected to the actuator line 17. Thereby, the boom cylinder 8 is supplied with discharge fluid of the hydraulic pump 4 via the directional flow control valve 1. Since the same applies to the arm cylinder 60 and the bucket cylinder 80, explanations thereof are omitted.

The operation lever unit 13 is a first operation lever unit for boom operation. The operation lever unit 13 has a pressure reducing valve that generates, based on the discharge pressure of the pilot pump 9, an operation pilot pressure Pp1 (hereinafter, referred to as a "boom-raising operation pilot pressure") as a boom-raising command or an operation pilot pressure Pp2 (hereinafter, referred to as a "boom-lowering operation pilot pressure") as a boom-lowering command that correspond to an operation direction of an operation lever 13*a*. The generated operation pilot pressure Pp1 or Pp2 is guided to a corresponding pressure-receiving section of the directional flow control valve 1, and the directional flow control valve 1 is switched to a boom-raising direction (the leftward direction in the illustration) or a boom-lowering direction (the rightward direction in the illustration) by the operation pilot pressure Pp1 or Pp2.

The operation lever unit 24 is a second operation lever unit for arm operation. The operation lever unit 24 has a pressure reducing valve that generates, based on the discharge pressure of the pilot pump 9, an operation pilot pressure Pp3 (hereinafter, referred to as a "arm-pulling operation pilot pressure") as an arm-crowding (arm-pulling) command or an operation pilot pressure Pp4 (hereinafter, referred to as a "arm-pushing operation pilot pressure") as an arm-dumping (arm-pushing) command that correspond to an operation direction of an operation lever 24*a*. The generated operation pilot pressure Pp3 or Pp4 is guided to a corresponding pressure-receiving section of the directional flow control valve 20, and the directional flow control valve 20 is switched to an arm-crowding direction (the leftward direction in the illustration) or an arm-dumping direction (the rightward direction in the illustration) by the operation pilot pressure Pp3 or Pp4.

The operation lever unit 27 is a third operation lever unit for bucket operation. The operation lever unit 27 has a pressure reducing valve that generates, based on the discharge pressure of the pilot pump 9, an operation pilot pressure Pp5 (hereinafter, referred to as a "bucket-pulling operation pilot pressure") as a bucket-crowding (bucket-pulling) command or an operation pilot pressure Pp6 (hereinafter, referred to as a "bucket-pushing operation pilot pressure") as a bucket-dumping (bucket-pushing) command that correspond to an operation direction of an operation lever 27*a*. The generated operation pilot pressure Pp5 or Pp6 is guided to a corresponding pressure-receiving section of the directional flow control valve 21, and the directional flow control valve 21 is switched to a bucket-crowding direction (the leftward direction in the illustration) or a bucket-dumping direction (the rightward direction in the illustration) by the operation pilot pressure Pp5 or Pp6.

Figure 3A:
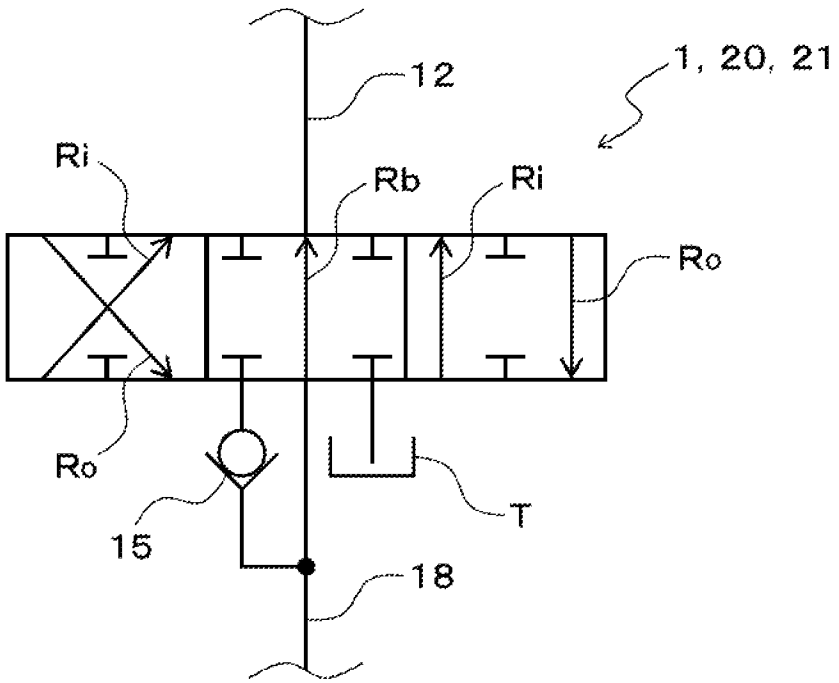
FIG. 3A is a diagram illustrating enlarged graphic symbols of directional flow control valves.

FIG. 3A is a diagram illustrating enlarged graphic symbols of the directional flow control valves 1, 20, and 21.

In FIG. 3A, the center bypass directional flow control valves 1, 20, and 21 each have a center bypass passage portion Rb, a meter-in passage portion Ri and a meter-out passage portion Ro. The center bypass passage portion Rb is positioned on the center bypass line 12, the meter-in passage portion Ri is positioned on a hydraulic line that establishes communication between a hydraulic fluid supply line 18 and the actuator line 16 or 17, the hydraulic fluid supply line 18 communicating with the discharged fluid line of the hydraulic pump 4. The meter-out passage portion Ro is positioned on a hydraulic line that establishes communication between the actuator line 16 or 17 and the hydraulic fluid tank T. The hydraulic fluid supply line 18 is provided with a load check valve 15 for preventing a reverse flow of hydraulic fluid from the hydraulic actuator side. The directional flow control valves 1, 20, and 21 adjust opening areas of the three passage portions Rb, Ri, and Ro according to their switching amounts (strokes) to thereby divide the delivery rate of the hydraulic pump 4 and supply hydraulic fluid to the hydraulic actuators 8, 60, and 80.

Figure 3B:
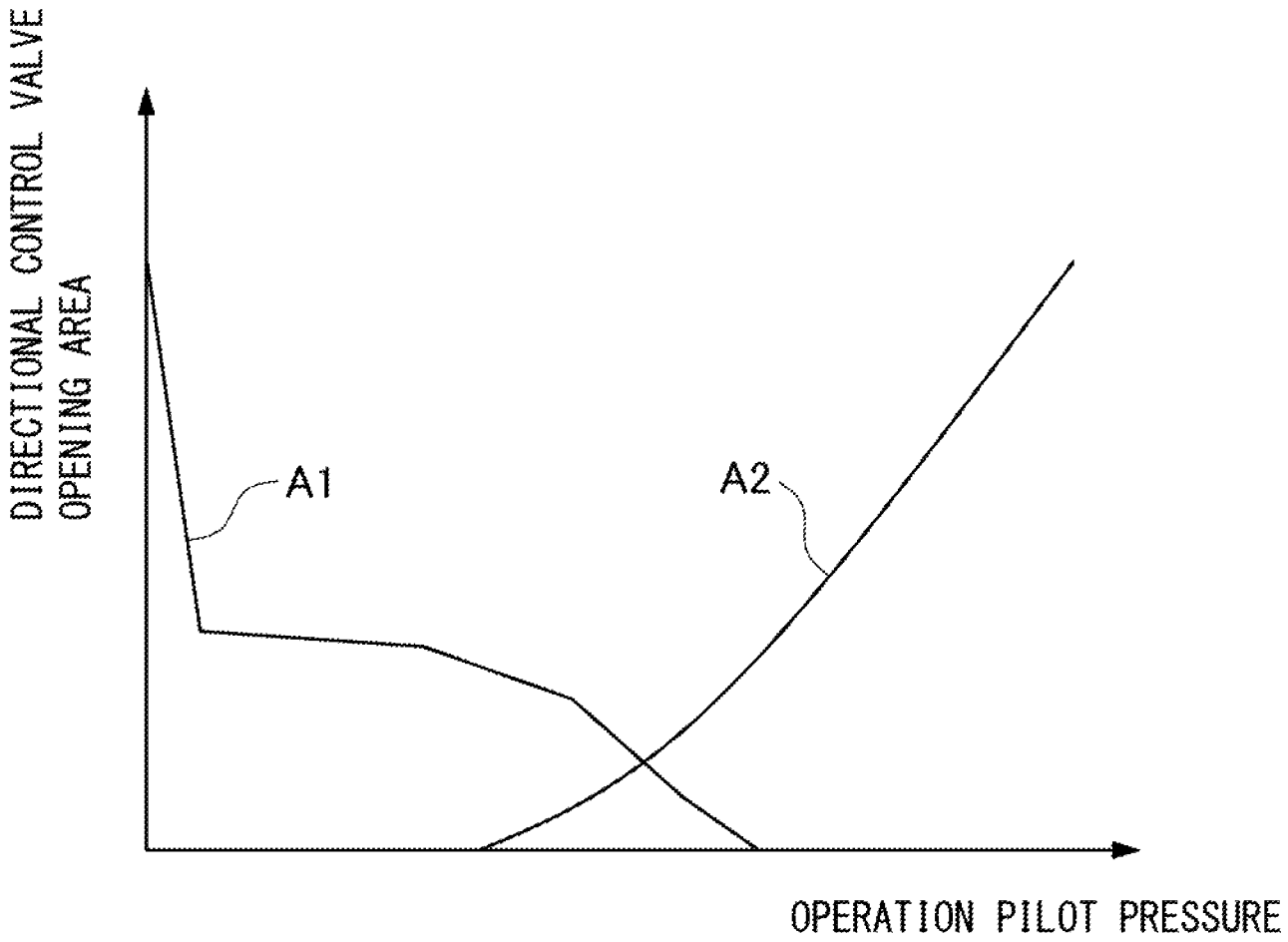
FIG. 3B is a figure illustrating opening area characteristics of the directional flow control valves.

FIG. 3B is a figure illustrating opening area characteristics of the directional flow control valves 1, 20, and 21.

In FIG. 3B, the center bypass passage portion Rb has opening area characteristics like the ones illustrated as A1, and the meter-in passage portion Ri and the meter-out passage portion Ro have opening area characteristics like the ones illustrated as A2. The horizontal axis in FIG. 3B indicates operation pilot pressures generated by a corresponding operation device, and approximately correspond to an operation amount of an operation lever (hereinafter, referred to as a "lever operation amount") or a spool stroke of the directional flow control valves 1, 20, and 21. The vertical axis in FIG. 3B indicates the opening area of the center bypass passage portion Rb, the meter-in passage portion Ri or the meter-out passage portion Ro.

As an operation lever of an operation device is operated and the operation pilot pressure rises, i.e., as a lever operation amount or a spool stroke of a directional flow control valve increases, an opening area A1 of the center bypass passage portion Rb decreases, and opening areas A2 of the meter-in passage portion Ri and the meter-out passage portion Ro increase. That is, with center bypass directional flow control valves, when a stroke of a directional flow control valve is equal to or smaller than a certain small stroke, the opening area A1 of the meter-in passage portion Ri is small, and the opening area A2 of the center bypass passage portion Rb is large; therefore, the discharge pressure of the hydraulic pump does not become higher than a load pressure of the hydraulic actuator, and the delivery rate of the hydraulic pump entirely becomes a rate of outflow to the hydraulic fluid tank T via the center bypass passage portion Rb. As the stroke of the directional flow control valve increases, the opening area A2 of the meter-in passage portion Ri increases, and the opening area A1 of the center bypass passage portion Rb decreases; therefore, the discharge pressure of the hydraulic pump 4 becomes higher than the load pressure of the hydraulic actuator, part of discharge fluid of the hydraulic pump 4 flows into the hydraulic actuator via the meter-in passage portion Ri, and the hydraulic actuator starts operating. If the stroke of the directional flow control valve increases further, correspondingly the opening area A2 of the meter-in passage portion Ri increases, and the opening area A1 of the center bypass passage portion Rb decreases; therefore, the flow rate of hydraulic fluid supplied to the hydraulic actuator via the meter-in passage portion Ri increases, and a speed of the hydraulic actuator also increases. In addition, the opening area characteristics illustrated in FIG. 3B are optimized for each of the directional flow control valves 1, 20, and 21 according to a capacity of a hydraulic actuator or operability of an operation lever.

Returning to FIG. 2, the hydraulic pump 4 includes a regulator 5. The regulator 5 receives inputs of a pump control pressure Ppc and the discharge pressure of the hydraulic pump 4 that it relates to, and performs positive control and input torque limiting control.

The hydraulic control system in the present embodiment further has, as its characteristic configurations: a center bypass control valve 2 arranged downstream of the directional flow control valves 1, 20, and 21 in the center bypass line 12; a pressure sensor (first pressure sensor) 7 that detects the boom-raising operation pilot pressure Pp1; a pressure sensor (second pressure sensor) 25 that detects the arm-pulling operation pilot pressure Pp3; a pressure sensor (third pressure sensor) 26 that detects the arm-pushing operation pilot pressure Pp4; a pressure sensor (fourth pressure sensor) 28 that detects the bucket-pulling operation pilot pressure Pp5; a pressure sensor (fifth pressure sensor) 29 that detects the bucket-pushing operation pilot pressure Pp6; a rotational speed sensor (rotational speed sensor) 19 that detects a rotational speed of the engine 6; a controller (controller) 10; and a solenoid proportional valve 3 that functions according to control signals from the controller 10 and generates a control pressure Pcb based on the discharge pressure of the pilot pump 9. The control pressure Pcb generated by the solenoid proportional valve 3 is applied to the center bypass control valve 2, and controls opening of a center bypass control valve 41.

Figure 4:
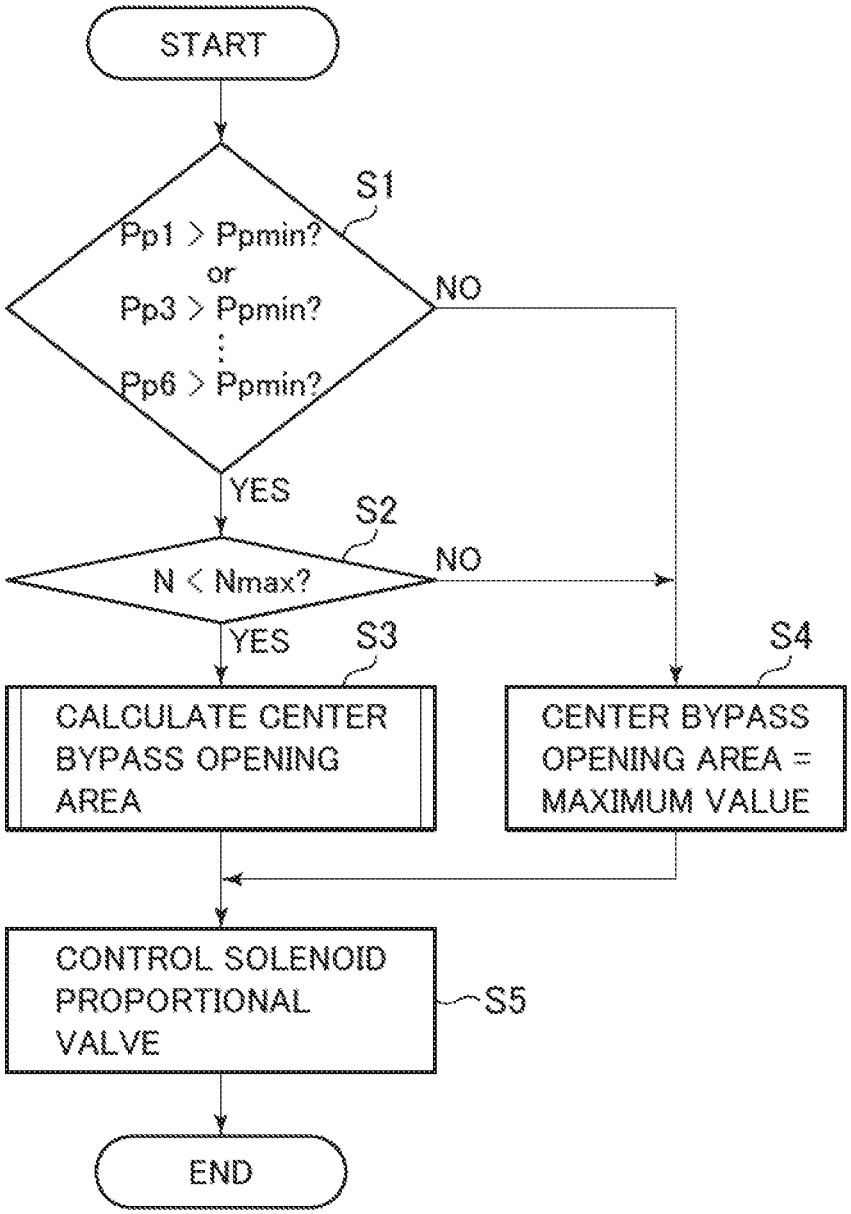
FIG. 4 is a flowchart illustrating processing content of a controller.

FIG. 4 is a flowchart illustrating processing content of the controller 10.

In FIG. 4, first, based on detection signals from the pressure sensors 7, 25, 26, 28, and 29, the controller 10 decides at Step S1 whether or not any of the boom-raising operation pilot pressure Pp1, the arm-pulling operation pilot pressure Pp3, the arm-pushing operation pilot pressure Pp4, the bucket-pulling operation pilot pressure Pp5 and the bucket-pushing operation pilot pressure Pp6 is higher than a predetermined value Ppmin. Here, the predetermined value Ppmin is a minimum value of operation pilot pressures generated by the operation devices 13, 24, and 27, and an operation pilot pressure being higher than the predetermined value Ppmin means that an operation lever has been operated. The operation pilot pressures Pp1 to Pp6 correspond to operation amounts of the directional flow control valves 1, 20, and 21, and the pressure sensors 7, 25, 26, 28, and 29 constitute an operation amount sensor that detects operation amounts of the directional flow control valves 1, 20, and 21.

If it is decided at Step S1 that any of the operation pilot pressures Pp1 to Pp5 is higher than the predetermined value Ppmin (YES), the controller 10 further decides at Step S2, based on a detection signal of the rotational speed sensor 19, whether or not a rotational speed N of the engine 6 is lower than a predetermined value Nmax.

If it is decided at Step S2 that the rotational speed N of the engine 6 is lower than the predetermined value Nmax (NO), an opening area Acb of the center bypass control valve 2 is calculated at Step S3. A method of calculating the opening area Acb is described below.

On the other hand, if it is decided at Step S1 that the boom-raising operation pilot pressure Pp1 is not higher than the predetermined value Ppmin (NO) or if it is decided at Step S2 that the engine rotational speed N is not lower than the predetermined value Nmax (NO), the opening area Acb of the center bypass control valve 2 is set to a maximum value (fully opened) at Step S4.

Figure 5:
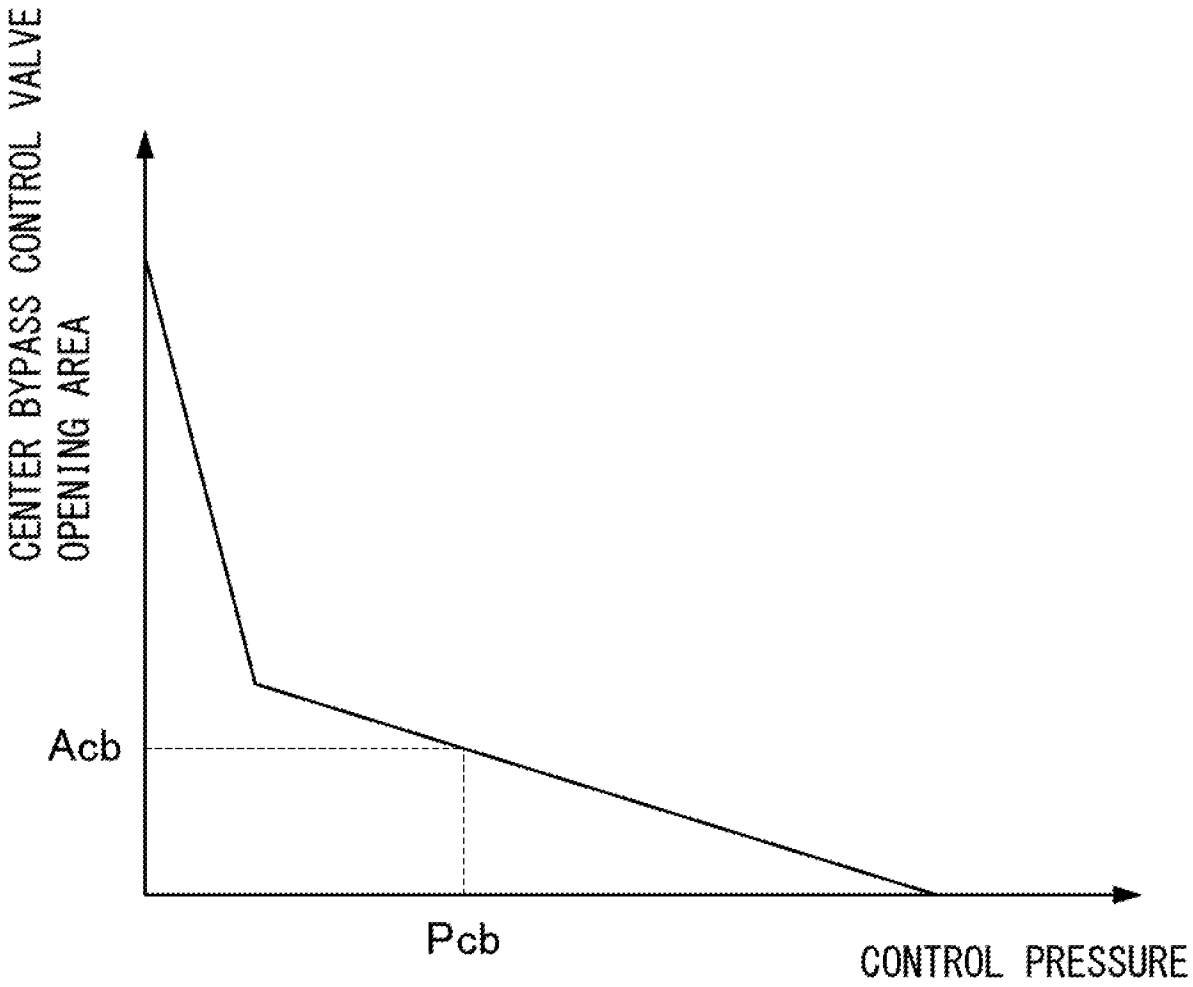
FIG. 5 is a figure illustrating a relation between control pressures applied to a center bypass control valve and an opening area of the center bypass control valve (conversion table).

Subsequent to Step S3 or S4, the controller 10 controls at Step S5 the solenoid proportional valve 3 such that the opening area Acb of the center bypass control valve 2 matches the opening area set at Step S3 or S4. Specifically, based on a conversion table illustrated in FIG. 5, the controller 10 calculates a control pressure Pcb corresponding to the opening area set at Step S3 or S4 in FIG. 4, and excites the solenoid proportional valve 3 such that the control pressure Pcb is generated by the solenoid proportional valve 3. With the above-mentioned processes, the opening area Acb of the center bypass control valve 2 is controlled.

Figure 6:
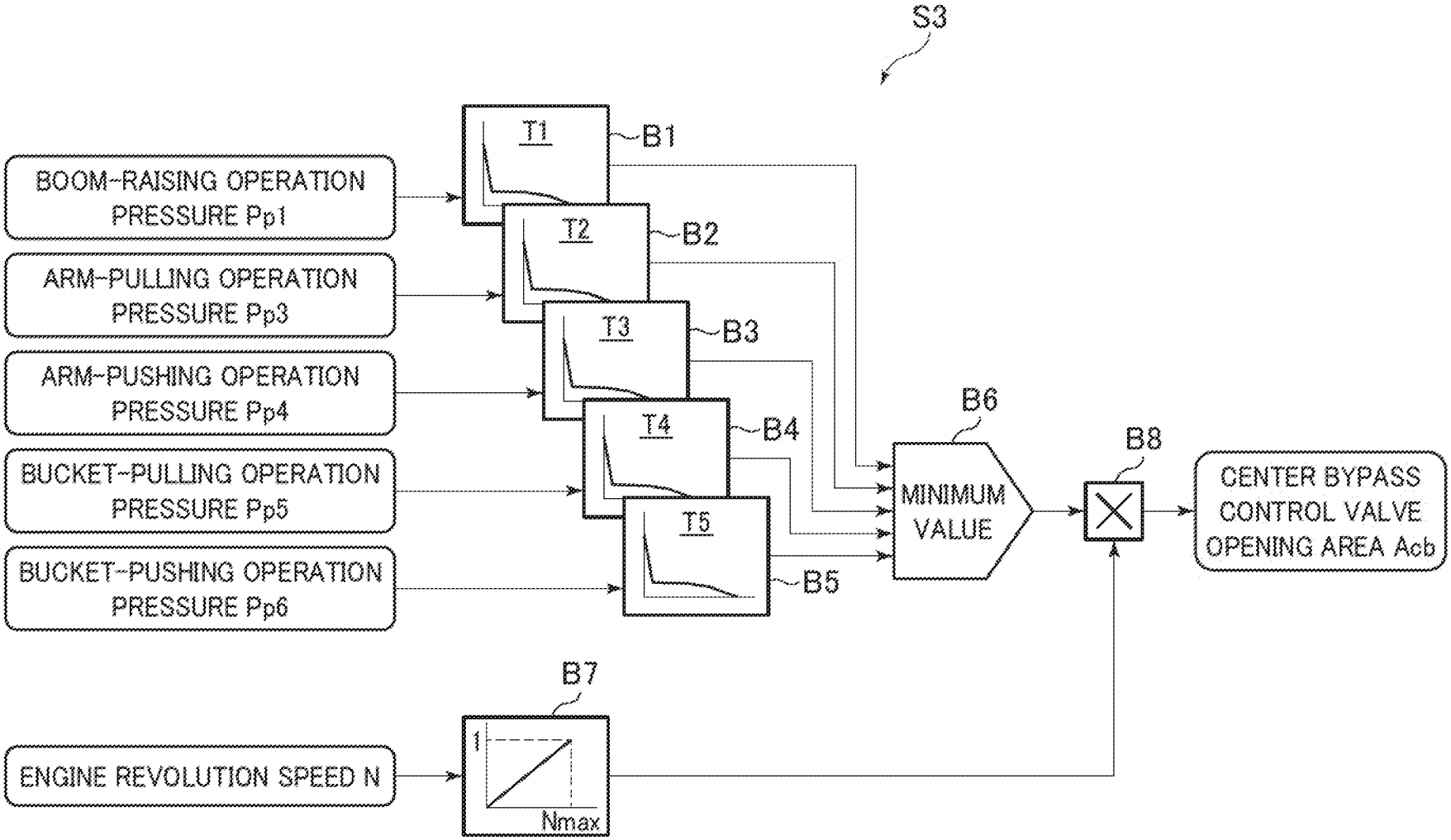
FIG. 6 is a block diagram illustrating a center bypass opening area calculation process.

FIG. 6 is a block diagram illustrating a center bypass opening area calculation process at Step S3 in FIG. 4.

In FIG. 6, Step S3 is constituted by calculation blocks B1 to B8, and the opening area Acb of the center bypass control valve 2 is calculated based on the operation pilot pressures Pp1 and Pp3 to Pp6 and the engine rotational speed N.

At the calculation block B1, the opening area of the center bypass passage portion Rb of the directional flow control valve 1 corresponding to the boom-raising operation pilot pressure Pp1 is calculated based on a conversion table T1. Here, the opening area characteristics A1, illustrated in FIG. 3A, of the center bypass passage portion Rb of the directional flow control valve 20 are set in the conversion table T1.

At the calculation block B2, the opening area of the center bypass passage portion Rb of the directional flow control valve 20 corresponding to the arm-pulling operation pilot pressure Pp2 is calculated based on a conversion table T2. Here, the opening area characteristics of the center bypass passage portion Rb of the directional flow control valve 20 are set in the conversion table T2.

At the calculation block B3, the opening area of the center bypass passage portion Rb of the directional flow control valve 20 corresponding to the arm-pushing operation pilot pressure Pp3 is calculated based on a conversion table T3. Here, the opening area characteristics of the center bypass passage portion Rb of the directional flow control valve 20 are set in the conversion table T3.

At the calculation block B4, the opening area of the center bypass passage portion Rb of the directional flow control valve 21 corresponding to the bucket-pulling operation pilot pressure Pp4 is calculated based on a conversion table T4. Here, the opening area characteristics of the center bypass passage portion Rb of the directional flow control valve 21 are set in the conversion table T4.

At the calculation block B5, the opening area of the center bypass passage portion Rb of the directional flow control valve 21 corresponding to the bucket-pushing operation pilot pressure Pp5 is output based on a conversion table T5. Here, the opening area characteristics of the center bypass passage portion Rb of the directional flow control valve 21 are set in the conversion table T5.

At the calculation block B6, a minimum value among the opening areas calculated at the calculation blocks B1 to B5, or among the opening areas of the center bypass passage portions Rb of the directional flow control valves 1, 20, and 21, is selected. This selection of the minimum value is equivalent to obtaining a combined opening area that is obtained by combining the opening areas of the directional flow control valves 1, 20, and 21 at the center bypass passage portions Rb. The center bypass passage portions Rb (center bypass restrictors) of the directional flow control valves 1, 20, and 21 are connected in series on the center bypass line 12, and a restrictor with the smallest opening area has dominant effects in a configuration with restrictors connected in series. Because of this, in the present embodiment, calculation of the combined opening area of the center bypass passage portions Rb of the directional flow control valves 1, 20, and 21 is simplified by approximately calculating the minimum value among the opening areas of the center bypass passage portions Rb as the combined opening area. Note that in the present embodiment, the slow speed operation work is assumingly a crane work, and load in the boom-lowering direction does not occur; therefore, at the calculation block B6, the boom-lowering operation pressure Pp2 is not taken into consideration. However, if load in the boom-lowering direction occurs, the minimum value needs to be selected from a group including also the boom-lowering operation pressure Pp2.

At a calculation block B7, a ratio of the engine rotational speed N detected by the rotational speed sensor 19 to a rated rotational speed Nmax (=N/Nmax) is calculated as a correction coefficient (0 to 1). Here, the rated rotational speed Nmax is an engine rotational speed used at the time of a normal work.

At a calculation block B8, the opening area Acb of the center bypass control valve 2 is calculated by multiplying the combined opening area calculated at the calculation block B6 by the correction coefficient (0 to 1) calculated at the calculation block B7. This calculation is equivalent to obtaining the opening area Acb of the center bypass control valve 2 when the combined opening area of the center bypass passage portions Rb of the directional flow control valves 1, 20, and 21 and the center bypass control valve 2 becomes a value obtained by multiplying the combined opening area of the center bypass passage portions Rb of the directional flow control valves 1, 20, and 21 by the above-mentioned correction coefficient (0 to 1). When the opening area Acb of the center bypass control valve 2 is made smaller than the combined opening area of the center bypass passage portions Rb of the directional flow control valves 1, 20, and 21, the restrictor of the center bypass control valve 2 becomes dominant in the center bypass line 12, and the combined opening area of the center bypass passage portions Rb of the directional flow control valves 1, 20, and 21 and the center bypass control valve 2 approximately matches the opening area of the center bypass control valve 2. Because of this, by making the opening area Acb of the center bypass control valve 2 equal to a value obtained by multiplying the combined opening area of the center bypass passage portions Rb of the directional flow control valves 1, 20, and 21 by the correction coefficient (0 to 1), the combined opening area of the center bypass passage portions Rb of the directional flow control valves 1, 20, and 21 and the center bypass control valve 2 can be made approximately match a value obtained by multiplying the combined opening area of the center bypass passage portions Rb of the directional flow control valves 1, 20, and 21 by the correction coefficient (0 to 1).

Figure 7:
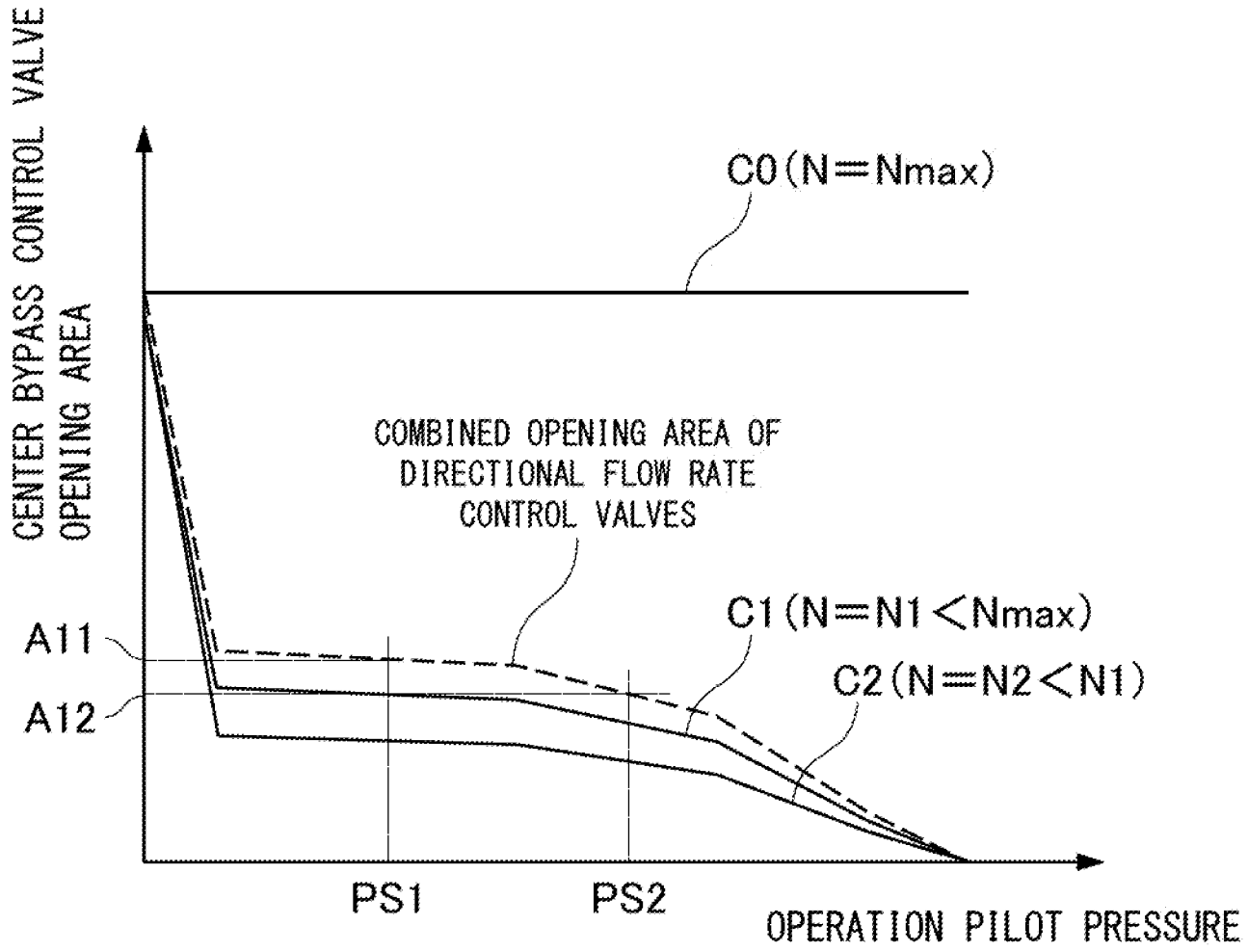
FIG. 7 is a figure illustrating a relation between operation pilot pressures of directional flow control valves and the opening area of the center bypass control valve (control characteristics of the center bypass control valve).

FIG. 7 is a figure illustrating a relation between the operation pilot pressures Pp1 and Pp3 to Pp6 of the directional flow control valves 1, 20, and 21 and the opening area Acb of the center bypass control valve 2 (control characteristics of the center bypass control valve 2).

In FIG. 7, C0 indicates control characteristics in a case where the engine rotational speed N is set to the rated rotational speed Nmax, and irrespective of the operation pilot pressures, the opening area Acb of the center bypass control valve 2 becomes the maximum value (fully opened). C1 indicates control characteristics in a case where the engine rotational speed N is set to N1 lower than the rated rotational speed NO, C2 indicates control characteristics in a case where the engine rotational speed N is set to N2 lower than N1, and they both approximately match ones obtained by multiplying the combined opening area, indicated by a broken line in the figure, of the directional flow control valves 1, 20, and 21 by ratios (correction coefficients) of the engine rotational speeds N1 and N2 to the rated rotational speed Nmax.

The functioning of the thus-configured hydraulic excavator is explained.

Returning to FIG. 1, a rear portion of the bucket 113 is equipped with a hook 130 that can be housed. The hook 130 is for crane works, and, as illustrated, a suspended load 131 is hung by a wire hooked on the hook 130 attached to the bucket rear portion. In this crane work, the suspended load 131 is moved (positionally adjusted) in the upward and downward directions (in a height direction) by raising and lowering of the boom 111 (boom-raising and boom-lowering), and the suspended load 131 is moved (positionally adjusted) in the forward and backward directions and lateral directions (horizontal directions) by pushing and pulling of the arm 112 (arm-dumping and arm-crowding) or swinging. In boom-raising, the bottom-side cylinder chamber 8*a* of the boom cylinder 8 becomes a load holding side, and a high holding pressure occurs in the bottom-side cylinder chamber 8*a*. In addition, crane works require slow speed operation since large load is being applied, and thus the engine rotational speed N is set lower than the rated rotational speed Nmax.

It is assumed that as a crane work, the suspended load 131 is moved upward by boom-raising in a state where the suspended load 131 is held in midair as illustrated in FIG. 1.

If an operator operates the operation lever 13*a* of the operation lever unit 13 for boom in the boom-raising direction, intending to move the suspended load 131 upward by boom-raising in the crane work, the operation pilot pressure Pp1 which is a boom-raising command is guided to the pressure-receiving section of the directional flow control valve 1 for boom, and the directional flow control valve 1 is operated to switch to the boom-raising direction (the leftward direction in the illustration).

On the other hand, the operation pilot pressure Pp1 which is a boom-raising command is detected by the pressure sensor 7, and a detection signal of the pressure sensor 7 is input to the controller 10 together with a detection signal of the rotational speed sensor 19 that detects the rotational speed of the engine 6. The controller 10 performs the processes in the flowchart illustrated in FIG. 4 based on these detection signals. At this time, since the operation pilot pressure Pp1>Ppmin and the engine rotational speed N<Nmax, results of the decisions at Steps S1 and S2 are both YES, and as a result of the processes at Steps S3 and S5, a control signal is output to the solenoid proportional valve 3. Thereby, the opening area of the center bypass control valve 2 is controlled such that the combined opening area of the center bypass line 12 shrinks correspondingly to lowering of the engine rotational speed N. Thereby, as in the case where the engine rotational speed N is set to the rated rotational speed Nmax, the discharge pressure of the hydraulic pump 4 rises correspondingly to an increase of the lever operation amount, and if the discharge pressure of the hydraulic pump 4 exceeds a high holding pressure for the bottom-side cylinder chamber 8*a* of the boom cylinder 8, the discharge fluid of the hydraulic pump 4 flows into the bottom-side cylinder chamber 8*a* of the boom cylinder 8 which is the load holding side, the boom cylinder 8 is extended, and the boom 111 revolves upward.

Effects of the present embodiment are explained in comparison with a conventional technique.

Figure 8:
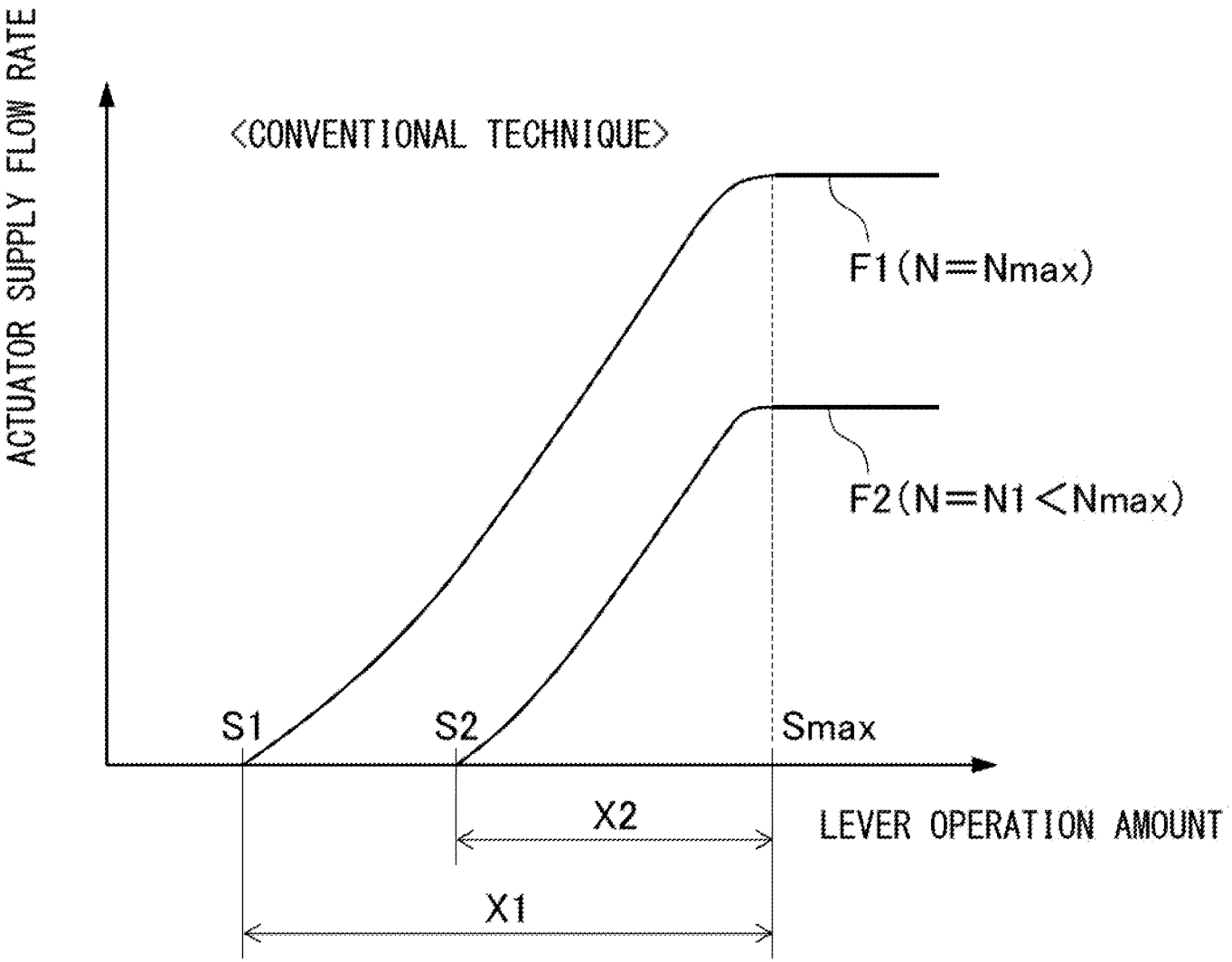
FIG. 8 is a figure illustrating relations between lever operation amounts and actuator supply flow rates in a conventional technique.

FIG. 8 is a figure illustrating relations between lever operation amounts and actuator supply flow rates in a conventional technique. F1 indicates a relation in the case where the engine rotational speed N is set to the rated rotational speed Nmax, and F2 indicates a relation in the case where the engine rotational speed N is set lower than the rated rotational speed Nmax.

In FIG. 8, if the lever operation amount reaches S1 in a state where the engine rotational speed N is set to the rated rotational speed Nmax, the operation pilot pressure reaches PS1 in FIG. 7, and the combined opening area of the center bypass passage portions Rb of the directional flow control valves 1, 20, and 21 shrinks to A11. Thereby, the discharge pressure of the hydraulic pump 4 exceeds the load pressure of the hydraulic actuator, and the hydraulic fluid starts flowing into the load holding side of the hydraulic actuator. As a result, a lever operation range up to the lever operation amount S1 becomes a dead zone, and a lever operation range between the lever operation amount S1 and a lever operation amount Smax where the rate of flow supplied to the hydraulic actuator becomes the maximum becomes a lever operation range X1 in which the rate of flow supplied to the hydraulic actuator is variable.

On the other hand, if, in a slow speed operation work such as a crane work, the engine rotational speed N is set to N1 lower than the rated rotational speed Nmax, the delivery rate of the hydraulic pump 4 lowers proportionally to the engine rotational speed N, and the discharge pressure of the hydraulic pump 4 also lowers similarly. If the lever operation amount reaches S1 in this state, the operation pilot pressure reaches PS1 in FIG. 7, and the combined opening area of the center bypass passage portions Rb of the directional flow control valves 1, 20, and 21 shrinks to A11, but due to the lowered delivery rate of the hydraulic pump 4, the discharge pressure of the hydraulic pump 4 does not exceed the load pressure of the hydraulic actuator, and the hydraulic fluid does not flow into the load holding side of the hydraulic actuator. If the operation lever is operated further, and the lever operation amount reaches S2, the operation pilot pressure reaches PS2 in FIG. 7, and the combined opening area of the center bypass passage portions Rb of the directional flow control valves 1, 20, and 21 shrinks to A12 as illustrated in FIG. 7. At this time, the discharge pressure of the hydraulic pump 4 exceeds the load pressure of the hydraulic actuator, and the hydraulic fluid starts flowing into the load holding side of the hydraulic actuator. As a result, the lever operation range up to the lever operation amount S2 becomes a dead zone, and the lever operation range in which the rate of flow supplied to the hydraulic actuator is variable shrinks from X1 to X2, and the operability in slow speed operation works deteriorates.

Figure 9:
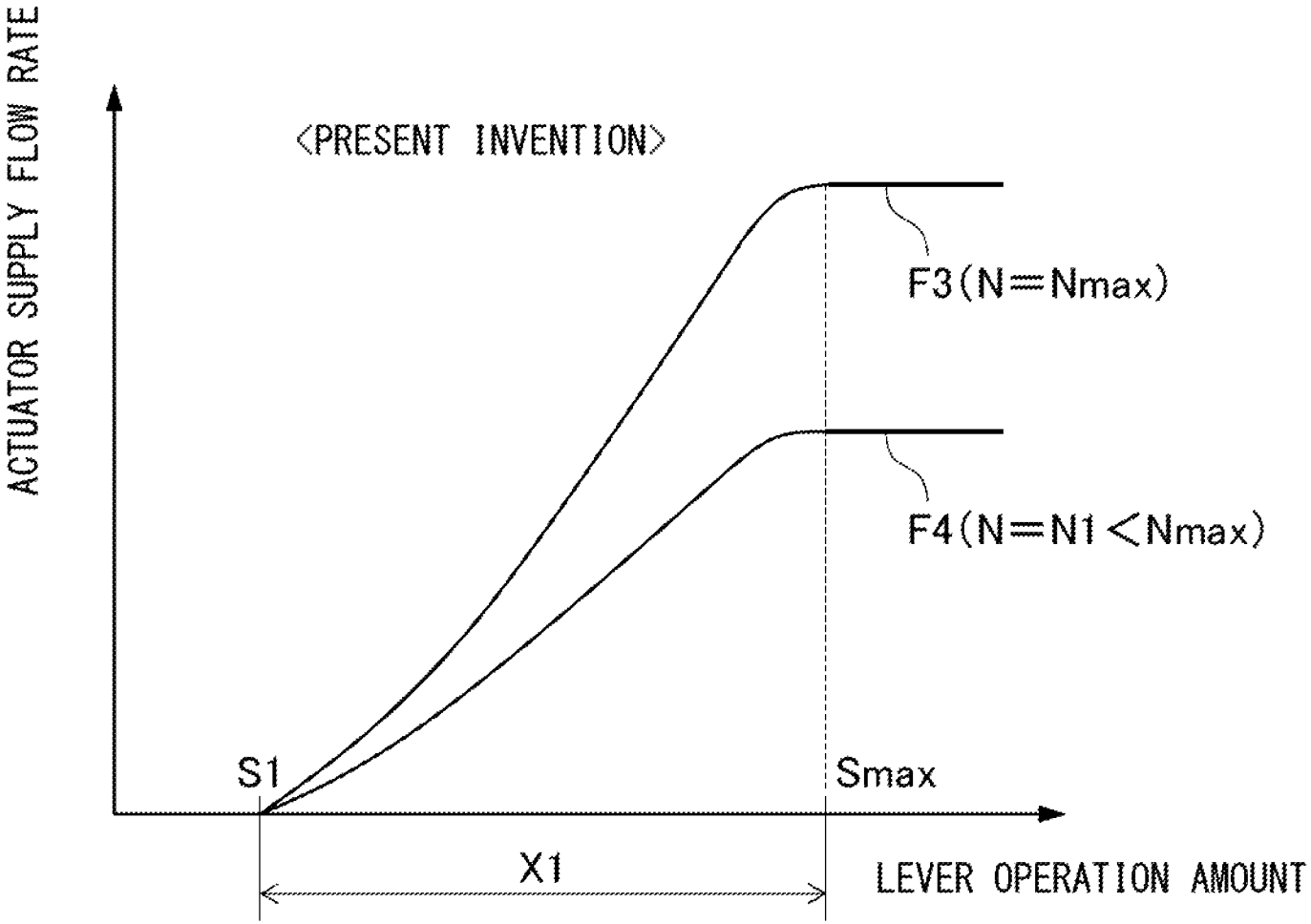
FIG. 9 is a figure illustrating a relation between lever operation amounts and actuator supply flow rates in the present embodiment.

FIG. 9 is a figure illustrating relations between lever operation amounts and actuator supply flow rates in the present embodiment. F3 indicates a relation in the case where the engine rotational speed N is set to the rated rotational speed Nmax, and F4 indicates a relation in the case where the engine rotational speed N is set lower than the rated rotational speed Nmax.

Since, in the present embodiment, if the engine rotational speed N is set equal to or higher than the rated rotational speed Nmax, a result of the decision at Step S2 in FIG. 4 is NO, and the opening area of the center bypass control valve 2 is set to the maximum value (fully opened) at Step S4. The combined opening area of the center bypass line 12 is thus not influenced by the center bypass control valve 2. Accordingly, F3 matches the characteristics F1 illustrated in FIG. 8 in the conventional technique, and the hydraulic excavator functions similar to the conventional technique.

On the other hand, if the engine rotational speed N is set to N1 lower than the rated rotational speed Nmax in a slow speed operation work such as a crane work, the delivery rate of the hydraulic pump 4 lowers proportionally to the engine rotational speed N, and the discharge pressure of the hydraulic pump 4 also lowers similarly. At this time, the opening area Acb of the center bypass control valve 2 is controlled to be smaller than the combined opening area of the center bypass passage portions Rb of the directional flow control valves 1, 20, and 21 proportionally to lowering of the engine rotational speed N. Thereby, if the lever operation amount reaches S1, the opening area of the center bypass control valve 2 shrinks to A12, the discharge pressure of the hydraulic pump 4 exceeds the load pressure of the hydraulic actuator, and the hydraulic fluid starts flowing into the load holding side of the hydraulic actuator.

According to the present embodiment, if the engine rotational speed N is set lower than the rated rotational speed Nmax, and the delivery rate of the hydraulic pump 4 is lowered in a slow speed operation work, with the lever operation amount S1 with which the hydraulic fluid starts flowing into the load holding side of the hydraulic actuator, or with which the hydraulic actuator starts moving, in the case where the engine rotational speed N is set to the rated rotational speed Nmax, the hydraulic fluid starts flowing into the load holding side of the hydraulic actuator. Thereby, since the lever operation range X1 in which the rate of flow supplied to the hydraulic actuator is variable is kept wide similar to that at the time when the engine rotational speed N is set to the rated rotational speed Nmax, deterioration of the operability in slow speed operation works can be prevented.

Although the embodiment of the present invention is described in detail hereinabove, the present invention is not limited to the above-mentioned embodiment, but include various modifications. For example, although in the above-mentioned embodiment, the present invention is applied to a hydraulic excavator, the present invention is not limited thereto, but can be applied to construction machines such as cranes. In addition, the above-mentioned embodiment is explained in detail in order to explain the present invention in an easy-to-understand manner, and is not necessarily limited to one including all the configurations explained.

DESCRIPTION OF REFERENCE CHARACTERS

1: Directional flow control valve (First directional flow control valve)
2: Center bypass control valve
3: Solenoid proportional valve
4: Hydraulic pump (Main pump)
5: Regulator
6: Engine
7: Pressure sensor (First pressure sensor)
8: Boom cylinder (Hydraulic actuator)
8*a*: Bottom-side cylinder chamber
8*b*: Rod-side cylinder chamber
9: Pilot pump
10: Controller (Controller)
11: Control valve device
12: Center bypass line
13: Operation lever unit (First operation lever unit)
13*a*: Operation lever
15: Load check valve
16, 17: Actuator line
18: Hydraulic fluid supply line
19: Rotational speed sensor (Rotational speed sensor)
20: Directional flow control valve (Second directional flow control valve)
21: Directional flow control valve (Third directional flow control valve)
22: Main relief valve
23: Pilot relief valve
24: Operation lever unit (Second operation lever unit)
24*a*: Operation lever
25: Pressure sensor (Second pressure sensor)
26: Pressure sensor (Third pressure sensor)
27: Operation lever unit (Third operation lever unit)
27*a*: Operation lever
28: Pressure sensor (Fourth pressure sensor)
29: Pressure sensor (Fifth pressure sensor)
60: Arm cylinder (Hydraulic actuator)
60*a*: Bottom-side cylinder chamber
60*b*: Rod-side cylinder chamber
80: Bucket cylinder (Hydraulic actuator)
80*a*: Bottom-side cylinder chamber
80*b*: Rod-side cylinder chamber
100: Lower track structure
101: Upper swing structure
102: Front work implement
103*a*, 103*b*: Crawler-type track device
104*a*, 104*b*: Travelling motor
106: Engine room
107: Cabin
111: Boom
112: Arm

113: Bucket
130: Hook
131: Suspended load
Pp1: Operation pilot pressure (Boom-raising)
Pp2: Operation pilot pressure (Boom-lowering)
Pp3: Operation pilot pressure (Arm-pulling)
Pp4: Operation pilot pressure (Arm-pushing)
Pp5: Operation pilot pressure (Bucket-pulling)
Pp6: Operation pilot pressure (Bucket-pushing)
Pcb: Control pressure
Ppc: Pump control pressure
Rb: Center bypass passage portion
Ri: Meter-in passage portion
Ro: Meter-out passage portion
T: Hydraulic fluid tank

The invention claimed is:

1. A construction machine including a hydraulic control system having a prime mover, a variable displacement hydraulic pump driven by the prime mover, a plurality of hydraulic actuators driven by discharge fluid of the hydraulic pump, a plurality of center bypass directional flow control valves arranged in a center bypass line having an upstream end connected to the hydraulic pump and a downstream end connected to a hydraulic fluid tank, and controlling flows of hydraulic fluid supplied from the hydraulic pump to the plurality of hydraulic actuators, and a plurality of operation devices provided correspondingly to the plurality of hydraulic actuators and operating the respective directional flow control valves, the construction machine comprising:

an operation amount sensor detecting operation amounts of the plurality of directional flow control valves;

a rotational speed sensor detecting a rotational speed of the prime mover;

a center bypass control valve arranged downstream of the plurality of directional flow control valves in the center bypass line; and a controller that is configured to:

control, if the rotational speed of the prime mover detected by the rotational speed sensor is equal to a rated rotational speed, which is an engine rotational speed used at a time of a normal work, the center bypass control valve such that an opening area of the center bypass control valve becomes a maximum value irrespective of the operation amounts of the plurality of operation devices detected by the operation amount sensor, and calculate, if the rotational speed of the prime mover detected by the rotational speed sensor is lower than the rated rotational speed, a combined opening area obtained by combining opening areas of the plurality of directional flow control valves in the center bypass line based on the operation amounts of the plurality of operation devices detected by the operation amount sensor, and to control the center bypass control valve such that the opening area of the center bypass control valve becomes smaller than the combined opening area.

2. The construction machine according to claim 1, wherein the controller is configured to calculate the opening area of the center bypass control valve by selecting a minimum value among opening areas of the plurality of directional flow control valves in the center bypass line as the combined opening area, and multiplying the combined opening area by a ratio of the engine rotational speed detected by the rotational speed sensor to the rated rotational speed.

3. The construction machine according to claim 1, wherein:

the construction machine is a hydraulic excavator that comprises a front work implement having a boom, an arm, and a bucket, and is equipped with a hook for crane works at the bucket, the plurality of hydraulic actuators includes a boom cylinder revolving the boom, an arm cylinder driving the arm, and a bucket cylinder revolving the bucket, the plurality of directional flow control valves includes a pilot-type first directional flow control valve controlling a flow of hydraulic fluid supplied from the hydraulic pump to the boom cylinder, a pilot-type second directional flow control valve controlling a flow of hydraulic fluid supplied from the hydraulic pump to the arm cylinder, and a pilot-type third directional flow control valve controlling a flow of hydraulic fluid supplied from the hydraulic pump to the bucket cylinder, the plurality of operation devices includes a first operation lever unit operating the first directional flow control valve, a second operation lever unit operating the second directional flow control valve, and a third operation lever unit operating the third directional flow control valve, and the operation amount sensor includes a first pressure sensor detecting a boom-raising operation pilot pressure generated by the first operation lever unit, a second pressure sensor detecting an arm-pulling operation pilot pressure generated by the second operation lever unit, a third pressure sensor detecting an arm-pushing operation pilot pressure generated by the second operation lever unit, a fourth pressure sensor detecting a bucket-pulling operation pilot pressure generated by the third operation lever unit, and a fifth pressure sensor detecting a bucket-pushing operation pilot pressure generated by the third operation lever unit.

* * * * *